US009964971B2

(12) United States Patent
Morita

(10) Patent No.: US 9,964,971 B2
(45) Date of Patent: May 8, 2018

(54) POWER SUPPLY DEVICE, POWER SUPPLY SYSTEM, AND POWER SUPPLY CONTROL METHOD

(71) Applicant: FUJITSU LIMITED, Kawasaki-shi, Kanagawa (JP)

(72) Inventor: Mikio Morita, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 309 days.

(21) Appl. No.: 14/818,353

(22) Filed: Aug. 5, 2015

(65) Prior Publication Data

US 2016/0072294 A1 Mar. 10, 2016

(30) Foreign Application Priority Data

Sep. 4, 2014 (JP) ..... 2014-180502

(51) Int. Cl.
*G05F 1/00* (2006.01)
*G05F 1/625* (2006.01)
*G05F 1/26* (2006.01)

(52) U.S. Cl.
CPC ..... *G05F 1/00* (2013.01)

(58) Field of Classification Search
CPC .. G05F 1/00; G05F 1/625; G06F 1/26; H01H 9/30
USPC ..... 307/11–42
See application file for complete search history.

(56) References Cited

U.S. PATENT DOCUMENTS 6,625,539 B1 * 9/2003 Kittell ..... B60L 3/12 701/117
2007/0145830 A1 * 6/2007 Lee ..... H02J 5/005 307/135
2008/0094768 A1 * 4/2008 Perra ..... A61K 31/53 361/79
2009/0021078 A1 * 1/2009 Corhodzic ..... G06F 1/263 307/67
2010/0308243 A1 * 12/2010 Bedingfield ..... F16K 7/045 251/129.15

(Continued)

FOREIGN PATENT DOCUMENTS

JP 2000-99174 A 4/2000
JP 2000-339040 12/2000

(Continued)

OTHER PUBLICATIONS

Japanese Office Action dated Mar. 13, 2018 for corresponding Japanese Patent Application No. 2014-180502 with, English Abstract 8 pages.

*Primary Examiner* — Brandon S Cole
(74) *Attorney, Agent, or Firm* — Fujitsu Patent Center

(57) ABSTRACT

A power supply device includes: a power supply circuit configured to supply electric power; a signal input-and-output portion to be coupled to a sub board, the sub board including a first load configured to receive the electric power and a voltage range generation circuit configured to generate a voltage range signal indicative of a power supply voltage range of the first load; and an arithmetic circuit configured to compute an output voltage of the power supply circuit based on the voltage range signal which is input via the signal input-and-output portion and first power supply voltage information relating to a first voltage at a first supply terminal of the first load to be supplied with the electric power.

15 Claims, 16 Drawing Sheets

(56) References Cited

U.S. PATENT DOCUMENTS

| | | | | |
|---|---|---|---|---|
| 2013/0278058 | A1* | 10/2013 | Testani | G05F 3/04 307/31 |
| 2013/0314069 | A1 | 11/2013 | Suzuki | |
| 2014/0232420 | A1* | 8/2014 | Luo | G06F 1/26 324/750.01 |
| 2015/0067362 | A1* | 3/2015 | Sultenfuss | G06F 1/3296 713/320 |
| 2015/0331435 | A1* | 11/2015 | Mac | G05F 1/625 700/298 |
| 2016/0357234 | A1* | 12/2016 | Luo | G06F 17/30424 |

FOREIGN PATENT DOCUMENTS

| | | | |
|---|---|---|---|
| JP | 2003-169470 | | 6/2003 |
| JP | 2014-3877 | A | 1/2014 |
| JP | 2014-60838 | A | 4/2014 |

* cited by examiner

POWER SUPPLY DEVICE, POWER SUPPLY SYSTEM, AND POWER SUPPLY CONTROL METHOD

CROSS-REFERENCE TO RELATED APPLICATION

This application is based upon and claims the benefit of priority of the prior Japanese Patent Application No. 2014-180502, filed on Sep. 4, 2014, the entire contents of which are incorporated herein by reference.

FIELD

The embodiments discussed herein are related to power supply devices, power supply systems, and their control methods.

BACKGROUND

The output voltage of a power supply device, to which a plurality of loads is coupled, is controlled.

The related art is disclosed in Japanese Laid-open Patent Publication No. 2000-339040 or Japanese Laid-open Patent Publication No. 2003-169470.

SUMMARY

According to an aspect of the embodiments, a power supply device includes: a power supply circuit configured to supply electric power; a signal input-and-output portion to be coupled to a sub board, the sub board including a first load configured to receive the electric power and a voltage range generation circuit configured to generate a voltage range signal indicative of a power supply voltage range of the first load; and an arithmetic circuit configured to compute an output voltage of the power supply circuit based on the voltage range signal which is input via the signal input-and-output portion and first power supply voltage information relating to a first voltage at a first supply terminal of the first load to be supplied with the electric power.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

For example, in a power supply device to which a plurality of loads is connected, power supply voltages at the loads are remotely sensed, and the output voltage of the power supply device is controlled. For example, in a power supply system including a voltage detector, a controller, and a power supply voltage outputting unit, electric power is supplied to a plurality of loads. The voltage detector detects a voltage at a supply terminal of each of the plurality of loads. The controller refers to voltage level information detected with the voltage detector and outputs control information for controlling the output voltage. The power supply voltage outputting unit adjusts, controls, and outputs the output voltage of the power supply device based on the control information from the controller.

The output voltage of the power supply device to which a plurality of loads is coupled may be controlled by various methods. For example, the various methods include a method for controlling the output voltage using an average value of remotely-sensed power supply voltages of the plurality of loads, a method for controlling the output voltage using variance from an acceptable center value of the power supply voltages of the plurality of loads, or a method for controlling the output voltage in accordance with the power supply voltage ranges of the plurality of loads.

For example, in a case where there is a change in a power supply voltage range of a load mounted on a sub board that receives a supply of electric power from a power supply device mounted on a main board, the voltage at the supply terminal of the load may not be controlled within the power supply voltage range of the load. For example, in a case where a sub board, on which a load is mounted whose power supply voltage range is reference voltage ±5%, is coupled in replace of a sub board on which a load is mounted whose power supply voltage range is the reference voltage ±8%, the voltage at the supply terminal of the load may not be controlled within the power supply voltage range of the load.

Figure 1:
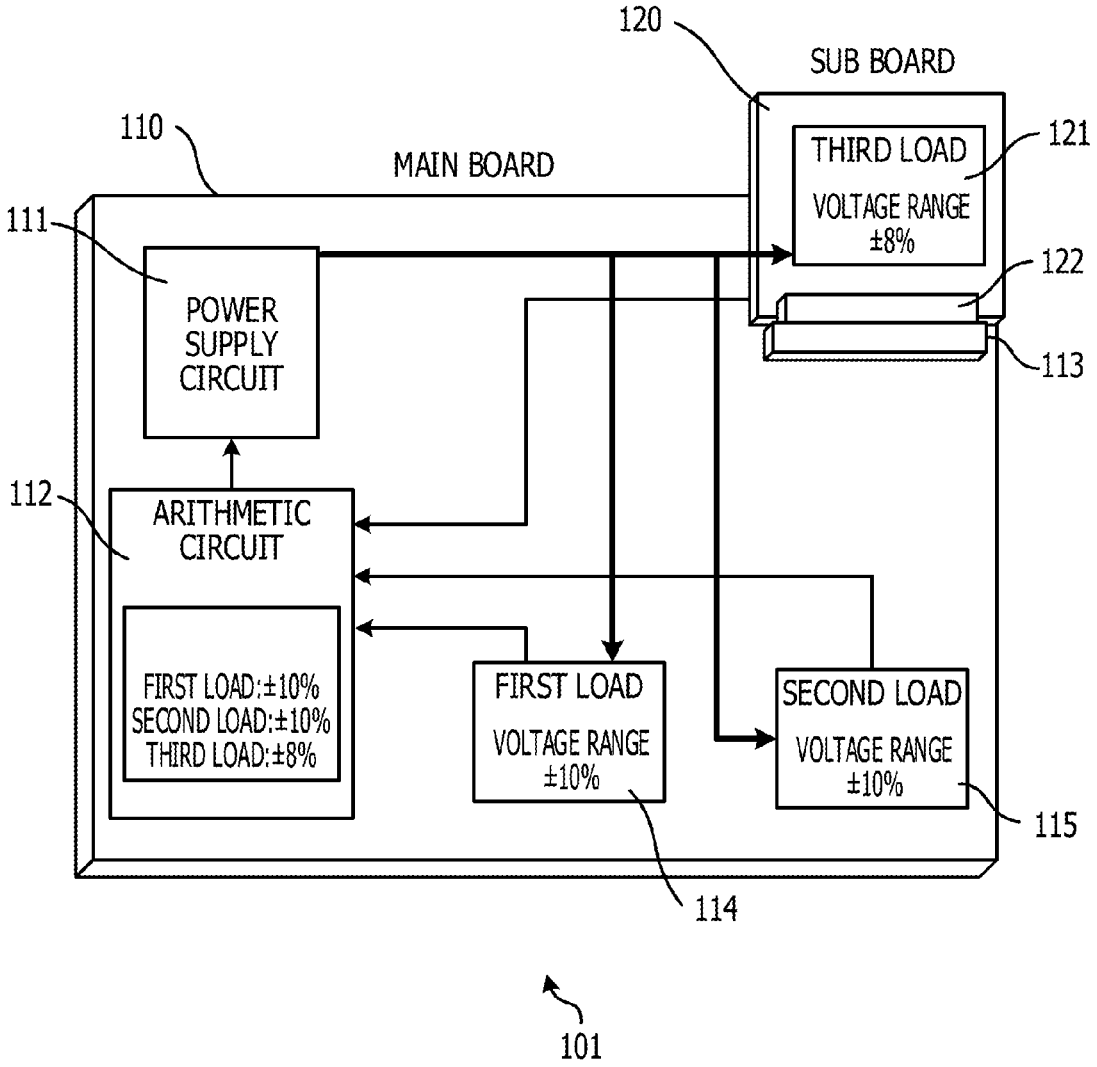
FIG. 1 illustrates an example of a power supply system.

FIG. 1 illustrates an example of a power supply system.

A power supply system 101 includes a main board 110 and a sub board 120. The main board 110 includes a power supply circuit 111, an arithmetic circuit 112, a main board input-and-output portion 113, a first load 114, and a second load 115. The sub board 120 includes a third load 121 and a sub board input-and-output portion 122. The power supply circuit 111, the arithmetic circuit 112, and the main board input-and-output portion 113 may correspond to a power supply device that supplies electric power to the first load 114, the second load 115, and the third load 121.

The power supply circuit 111 supplies electric power to each of the first load 114, the second load 115, and the third load 121. The voltages at supply terminals of the first load 114, the second load 115, and the third load 121, at which respective electric powers are supplied, are lower than the output voltage of the power supply circuit 111 due to voltage drops at wiring between the power supply circuit 111 and the respective loads. The arithmetic circuit 112 performs a certain arithmetic operation on remotely-sensed voltages at the supply terminals of the first load 114, the second load 115, and the third load 121, and feeds back operation results to the power supply circuit 111. The arithmetic circuit 112 controls the output voltage of the power supply circuit 111 in such a way that the supply terminal voltages of the loads stay inside their respective power supply voltage ranges of the loads even in cases where the output voltage of the power supply circuit 111 drops at the supply terminals of the loads. The main board input-and-output portion 113 may be an interface portion with the sub board 120. The first load 114 and the second load 115 are each a load whose power supply voltage range is the reference voltage $V_0$±10%, and output an input voltage to the arithmetic circuit 112.

The third load 121 is a load whose power supply voltage range is the reference voltage $V_0$±8% and outputs an input voltage to the arithmetic circuit 112. The sub board input-and-output portion 122 may be an interface portion with the main board 110.

In the power supply system 101, the power supply voltage ranges of the first load 114 and the second load 115 are the reference voltage $V_0$±10% whereas the power supply voltage range of the third load 121 is the reference voltage $V_0$±8%. The arithmetic circuit 112 computes the output voltage of the power supply circuit 111 by weighting in accordance with the power supply voltage ranges. For example, weighted averaging in accordance with the power supply voltage ranges may be used.

An equation (1) is an arithmetic equation to be computed with the arithmetic circuit 112.

$$V = \frac{1}{\frac{1}{a}+\frac{1}{b}+\frac{1}{c}} \times \left\{\frac{1}{a} \times V_a \frac{1}{b} V_b \frac{1}{c} \times V_c\right\} \tag{1}$$

V is a target voltage that enables supplying of desired voltages for the supply terminals of the respective loads. a, b, and c are the power supply voltage ranges of the first load 114, the second load 115, and the third load 121, respectively, and are expressed in % in terms of deviation from the reference voltage $V_0$. For example, a and b may be 10%, and c may be 8%. Va, Vb, and Vc indicate the remotely-sensed voltages at the supply terminals of the first load 114, the second load 115, and the third load 121, respectively.

The arithmetic circuit 112 computes the target voltage V based on the equation (1). The arithmetic circuit 112 computes a differential voltage ΔV ($\Delta V=V_0-V$) between the computed target voltage V and the reference voltage $V_0$. The arithmetic circuit 112 alters the output voltage Vout of the power supply circuit 111 to Vout'=ΔV+Vout.

Figure 2:
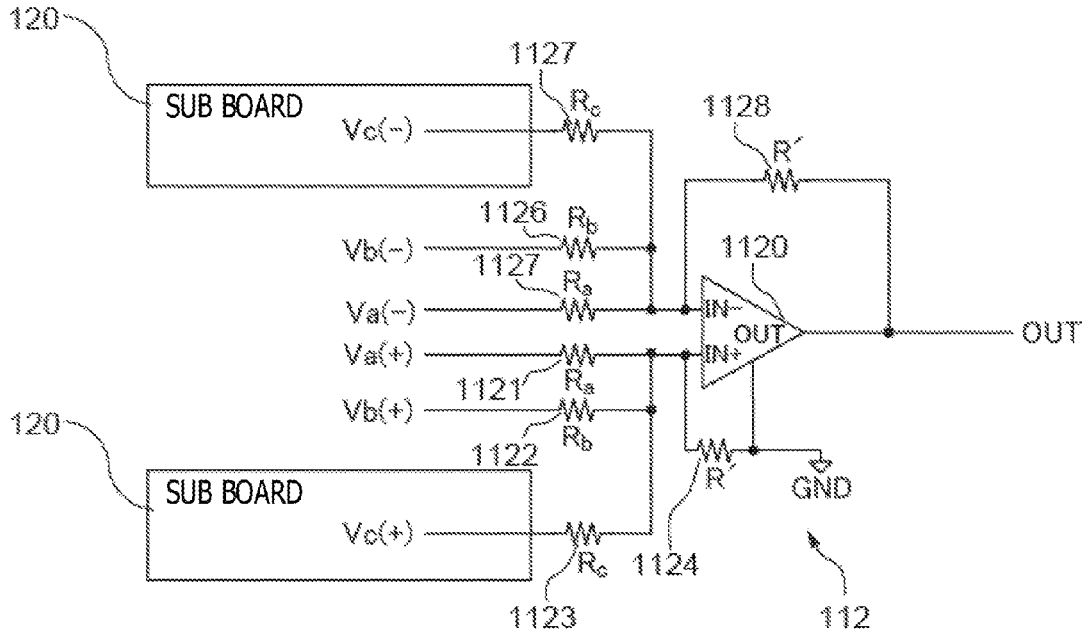
FIG. 2 illustrates an example of an arithmetic circuit.

FIG. 2 illustrates an example of a arithmetic circuit.

The arithmetic circuit 112 includes an operational amplifier 1120, a first load positive resistor 1121 to a third load positive resistor 1123, a feedback positive resistor 1124, a first load negative resistor 1125 to a third load negative resistor 1127, and a feedback negative resistor 1128. Va(+) to Vc(+) and Va(−) to Vc(−) are remotely-sensed power supply voltages of the first load 114 to the third load 121 and ground voltage, respectively. Va in the equation (1) is expressed as (Va=Va(+)−Va(−)), Vb is expressed as (Vb=Vb(+)−Vb(−)), and Vc is expressed as (Vc=Vc(+)−Vc(−)). The resistances of the first load positive resistor 1121 and the first load negative resistor 1125 are Ra, the resistances of the second load positive resistor 1122 and the second load negative resistor 1126 are Rb, and the resistances of the third load positive resistor 1123 and the third load negative resistor 1127 are Rc. Ra, Rb, and Rc may be values proportional to the power supply voltage ranges of the first load 114, the second load 115, and the third load 121, and may be, for example, Ra:Rb:Rc=10:10:8. The resistances of the feedback positive resistor 1124 and the feedback negative resistor 1128 are R', and R' represents a relationship between the resistances Ra, Rb, and Rc. For example, the relationship may be expressed as R'=1/(1/Ra+1/Rb+1/Rc).

Figure 3:
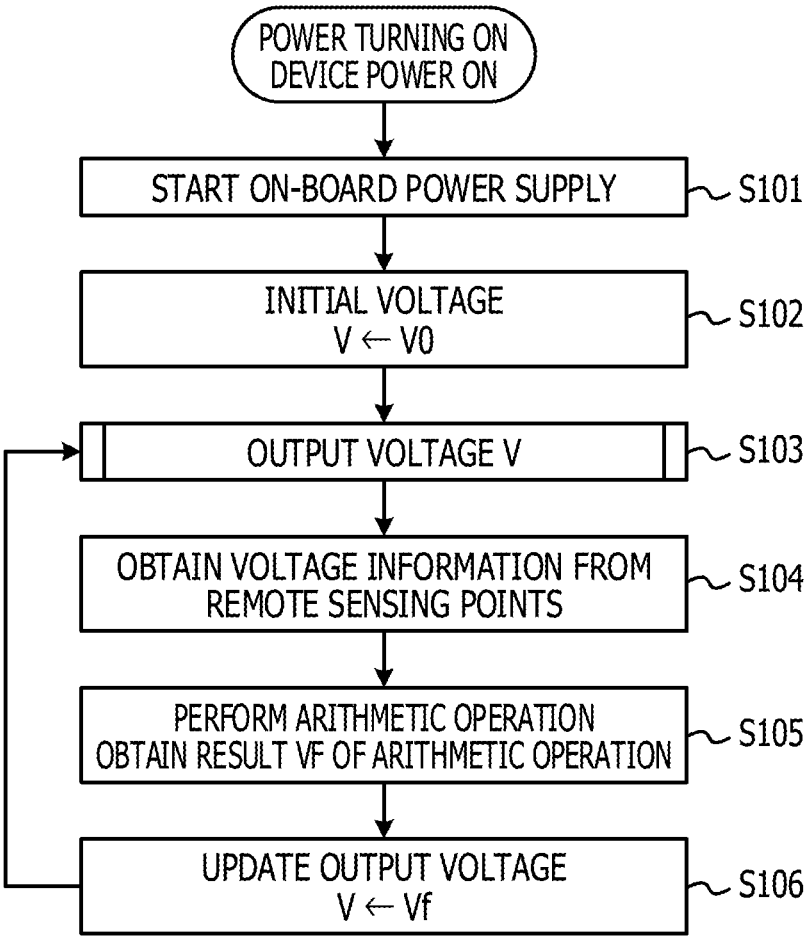
FIG. 3 illustrates an example of a process of a power supply device.

FIG. 3 illustrates an example of a process of a power supply device. For example, a power supply device including the power supply circuit 111, the arithmetic circuit 112, and the main board input-and-output portion 113 illustrated in FIG. 1 may perform the process illustrated in FIG. 3.

When a power supply is turned on, the power supply system 101 starts its operation (S101). The output voltage V of the power supply circuit 111 is set to the reference voltage $V_0$ (S102). The power supply circuit 111 outputs the output voltage V that is set to the reference voltage $V_0$ (S103). The arithmetic circuit 112 performs remote sensing of the respective voltages at the supply terminals of the first load 114, the second load 115, and the third load 121, and obtains power supply voltage information indicative of remotely-sensed voltages (S104). The arithmetic circuit 112 computes the target voltage based on the equation (1) using the power supply voltage information thus obtained (S105), and alters the output voltage of the power supply circuit 111 to a voltage corresponding to the target voltage thus computed (S106). The power supply circuit 111 outputs the output voltage V thus altered (S103). Hereinafter, the operations S103 to S106 may be repeated at intervals of a certain time period.

Figure 4:
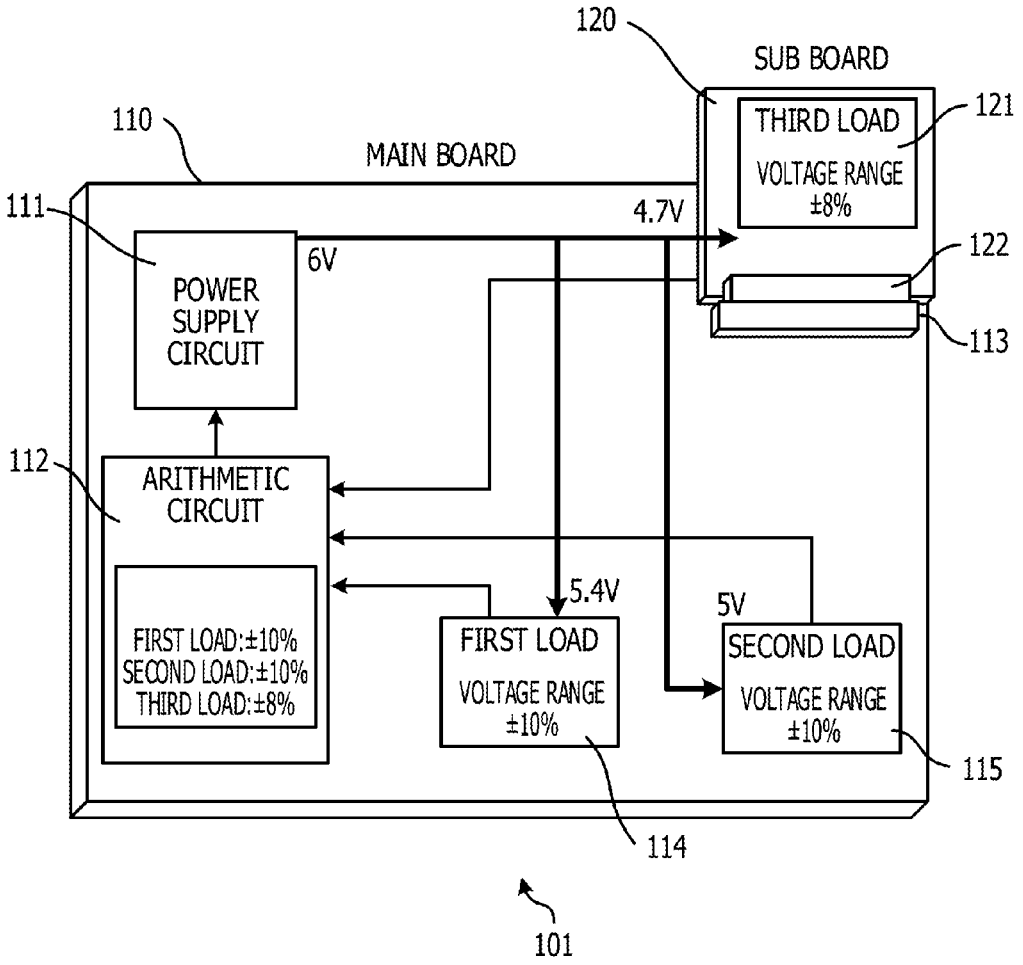
FIG. 4 illustrates an example of a voltage control of a power supply system.

FIG. 4 illustrates an example of a voltage control of a power supply system. A power supply system 101 illustrated in FIG. 4 may be the power supply system 101 illustrated in FIG. 1. In FIG. 4, the reference voltage $V_0$ may be 5 V, the power supply voltage range "a" of the first load 114 and the power supply voltage range "b" of the second load 115 may be ±10%, and the power supply voltage range "c" of the third load 121 may be ±8%.

In FIG. 4, an output voltage of 6 V outputted from the power supply circuit 111 may drop by 0.6 V and be supplied to the supply terminal of the first load 114 as a voltage of 5.4 V, and may drop by 1 V and be supplied to the supply terminal of the second load 115 as a voltage of 5 V. The output voltage of 6 V may drop by 1.3 V and be supplied to the supply terminal of the third load 121 as a voltage of 4.7 V.

In FIG. 4, the arithmetic circuit 112 controls the output voltage of the power supply circuit 111 in such a way that the voltages at the first load 114 and the second load 115 are within the voltage range of the reference voltage 5 V±10% and that the voltage at the third load 121 is within the voltage range of the reference voltage 5 V±8%. The voltage supplied to the supply terminal of the first load 114 may be at 5.4 V that is within the power supply voltage range of 5 V±10% of the first load 114, and the voltage supplied to the supply terminal of the second load 115 may be at 5 V that is within the power supply voltage range of 5 V±10% (from 4.5 V to 5.5 V) of the second load 115. The voltage supplied to the supply terminal of the third load 121 may be at 4.7 V that is within the power supply voltage range of 5 V±8% (from 4.68 V to 5.32 V) of the third load 121.

Figure 5:
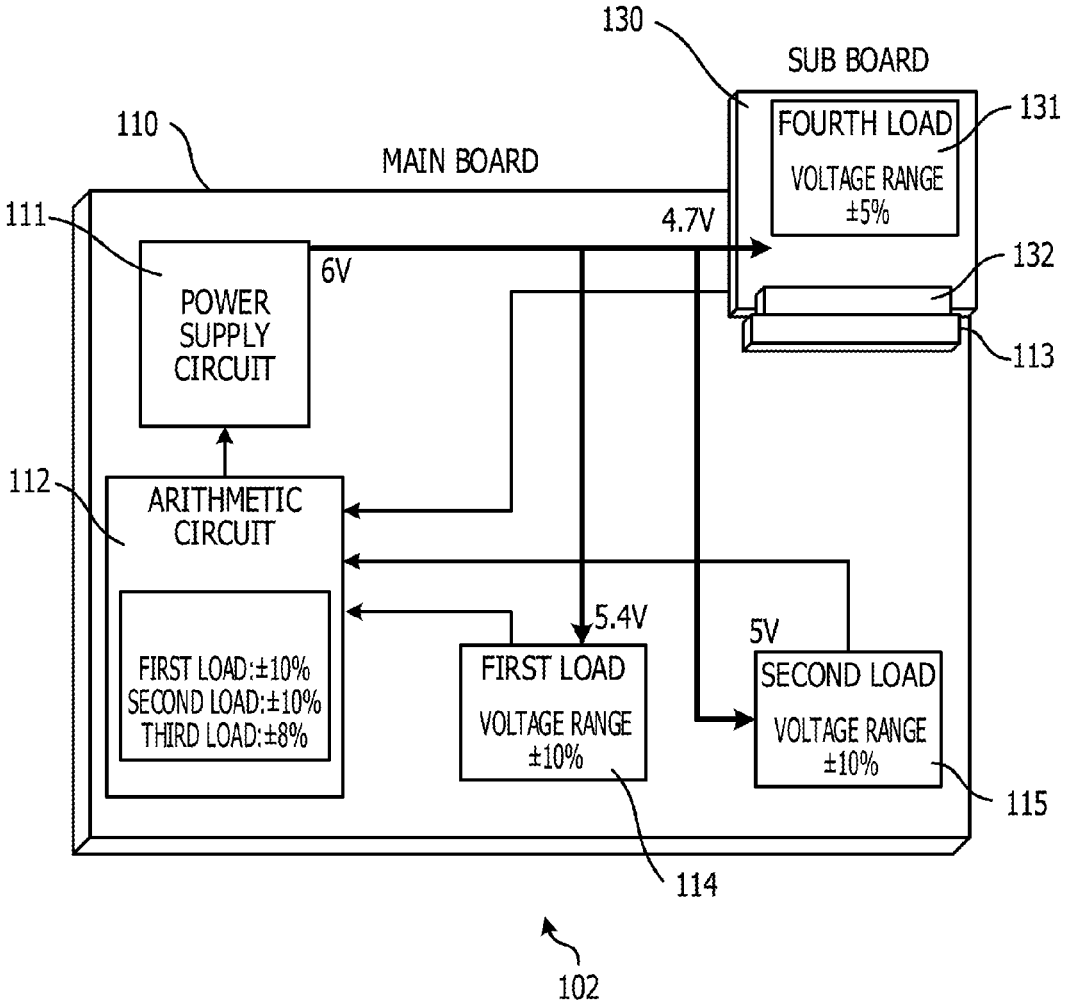
FIG. 5 illustrates an example of a power supply system.

FIG. 5 illustrates an example of a power supply system. In a power supply system 102 illustrated in FIG. 5, the sub board 120 on which the third load 121 is mounted is removed from the power supply system 101 illustrated in FIG. 1, and a sub board on which a fourth load is mounted is coupled. The fourth load has a narrower power supply voltage range than that of the third load 121.

FIG. 5 illustrates the power supply system 102 to which the sub board, on which the fourth load is mounted, is coupled.

A sub board 130 includes the fourth load 131 and a sub board input-and-output portion 132 that serves as an interface portion with the main board 110. The fourth load 131 has a reference voltage $V_0$ of 5 V and a power supply voltage range of ±5%. The power supply voltage range of the fourth load 131 included in the sub board 130 is between 4.75 V and 5.25 V whereas the power supply voltage range of the third load 121 is between 4.68 V and 5.32 V. In FIG. 5, the power supply circuit 111 outputs an output voltage of 6 V, and a voltage of 4.7 V is supplied to the supply terminal of the fourth load 131. The power supply voltage range of the fourth load 131 is between 4.75 V and 5.25 V, and the voltage of 4.7 V is outside that range.

As illustrated in FIG. 5, in the case where a sub board is exchanged with another sub board on which a load having a narrower power supply voltage range is mounted, a voltage which is supplied in accordance with the output voltage output from the power supply circuit 111 may not be inside the power supply voltage range of the load mounted on the sub board whose power supply voltage range is changed.

Figure 6:
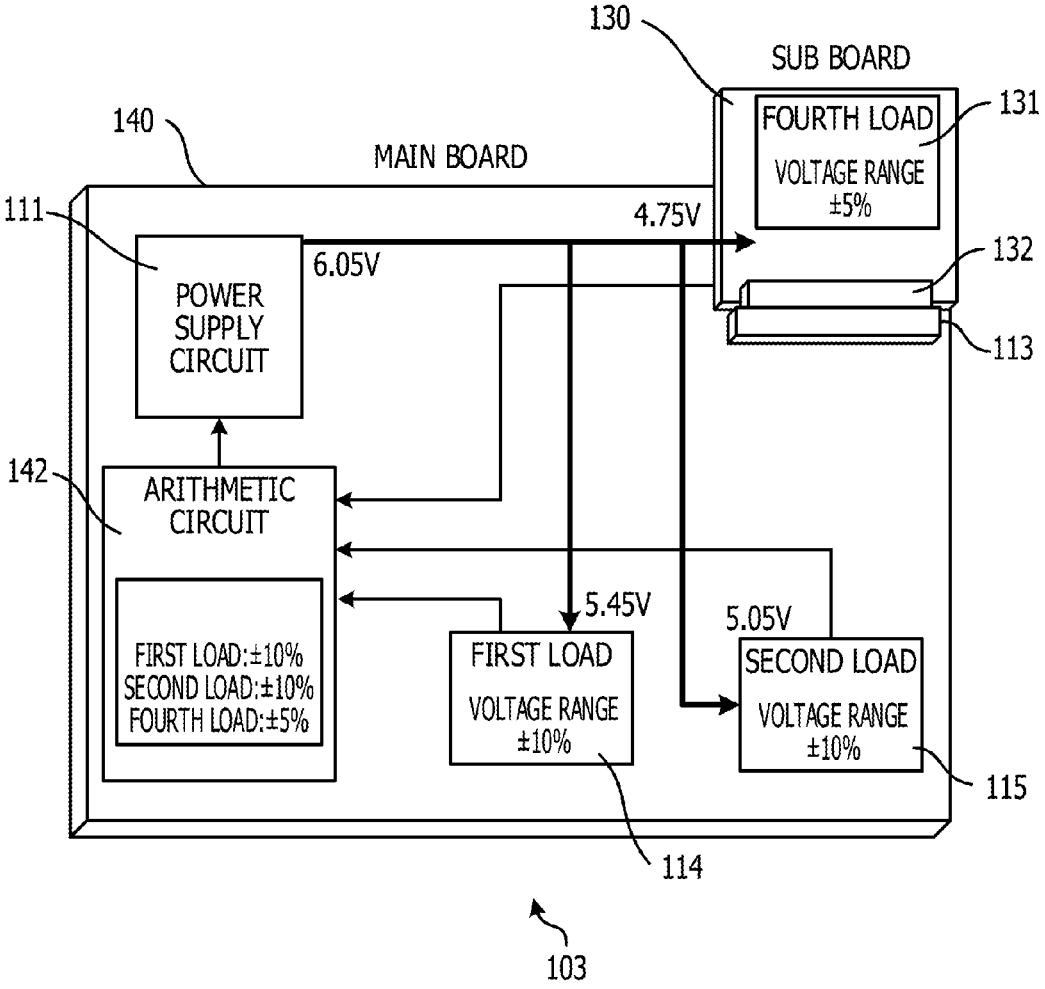
FIG. 6 illustrates an example of a power supply system.

FIG. 6 illustrates an example of a power supply system.

A power supply system 103 illustrated in FIG. 6 is different from the power supply system 102 illustrated in FIG. 5 in that the power supply system 103 includes a main board 140 in place of the main board 110. The main board 140 may include an arithmetic circuit 142 in place of the arithmetic circuit 112 for performing an arithmetic operation corresponding to the power supply voltage range of the fourth load 131.

In the power supply system 103, the power supply circuit 111 outputs an output voltage of 6.05 V, increased by 0.05 V from 6 V of the power supply system 102, by causing the arithmetic circuit 142 to perform the arithmetic operation corresponding to the power supply voltage range of the fourth load 131, which is ±5%. In the power supply system 103, by causing the power supply circuit 111 to output an output voltage of 6.05 V, a voltage of 4.75 V that falls within the power supply voltage range of 4.75 V to 5.25 V is supplied to the supply terminal of the fourth load 131.

In the power supply system 103, all of the first load 114, the second load 115, and the fourth load 131 may be supplied voltages that fall within their respective power supply voltage ranges by changing the arithmetic circuit 112 to the arithmetic circuit 142 that corresponds to the power supply voltage range of the fourth load 131.

For example, in the power supply systems relating to FIG. 1 to FIG. 6, the arithmetic circuit, which computes the output voltage of the power supply circuit, is changed every time the power supply voltage range of the load mounted on the sub board is changed. Thus, changing in response to the change in power supply voltage range of load may not be easy.

For example, in the power supply system, the arithmetic circuit may determine the output voltage of the power supply circuit using the power supply voltage range of a load, which is obtained from a voltage range generation circuit mounted on a sub board on which the load is mounted. In the power supply system, the arithmetic operation may be performed without altering the configuration of the arithmetic circuit even in the case where sub boards are exchanged and the power supply voltage range of a load mounted on a sub board is changed.

Figure 7:
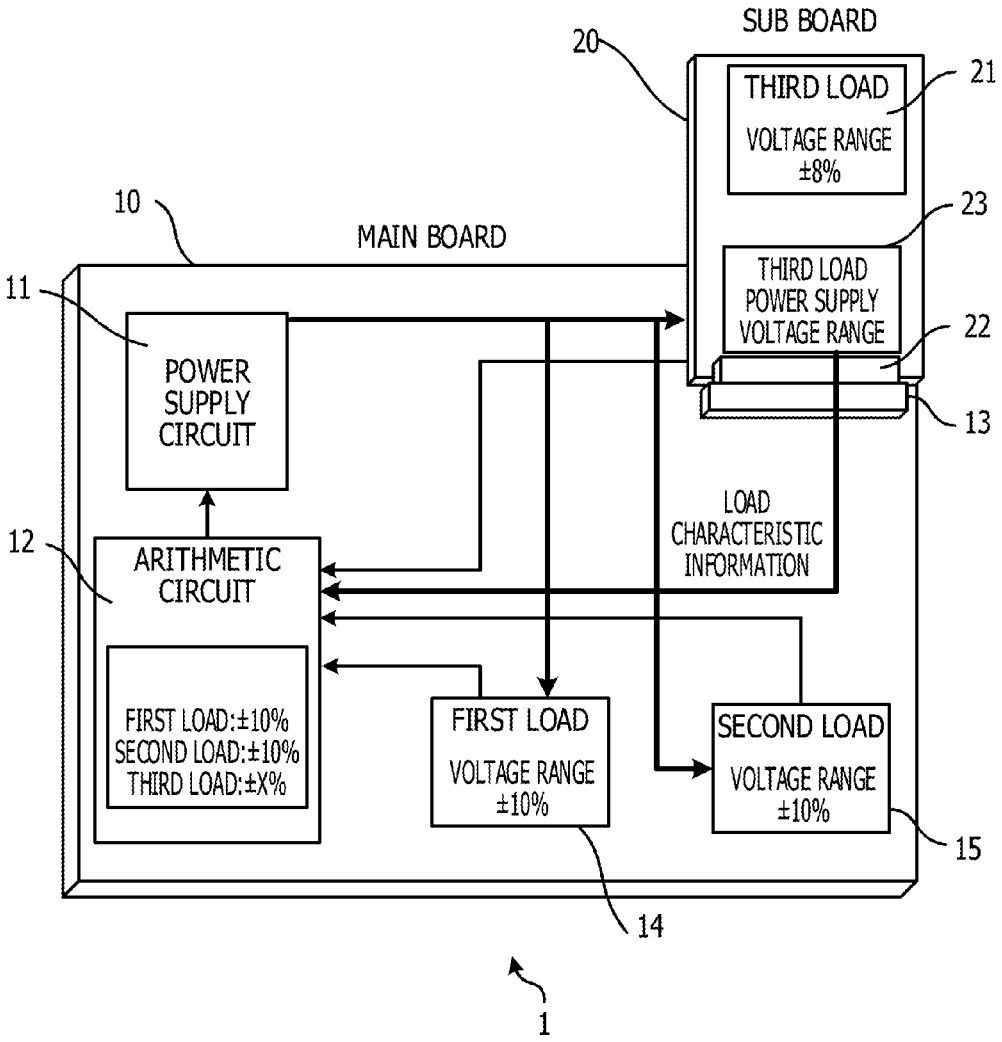
FIG. 7 illustrates an example of a power supply system.

FIG. 7 illustrates an example of a power supply system.

A power supply system 1 includes a main board 10 and a sub board 20. The main board 10 includes a power supply circuit 11, an arithmetic circuit 12, a main board input-and-output portion 13, a first load 14, and a second load 15. The sub board 20 includes a third load 21, a sub board input-and-output portion 22, and a voltage range generation circuit 23. The power supply circuit 11, the arithmetic circuit 12, and the main board input-and-output portion 13 may correspond to a power supply device that supplies electric power to the first load 14, the second load 15, and the third load 21.

The power supply circuit 11, the main board input-and-output portion 13, the first load 14, and the second load 15 may have configurations and functionalities corresponding to those of the power supply circuit 111, the main board input-and-output portion 113, the first load 114, and the second load 115 illustrated in FIG. 1 to FIG. 6, respectively. The third load 21 and the sub board input-and-output portion 22 may have configurations and functionalities corresponding to those of the third load 121 and the sub board input-and-output portion 122 illustrated in FIG. 1 to FIG. 6, respectively.

The arithmetic circuit 12 obtains the power supply voltage range of the third load 21 from the sub board 20 as load characteristic information. The arithmetic circuit 12 computes the output voltage of the power supply circuit 11 by using the power supply voltage range of the third load 21 obtained as the load characteristic information and performing weighting corresponding to the power supply voltage ranges based on the equation (1).

The voltage range generation circuit 23 generates and outputs a voltage range signal indicative of the power supply voltage range that serves as operation voltage information of the third load 21.

Figure 8:
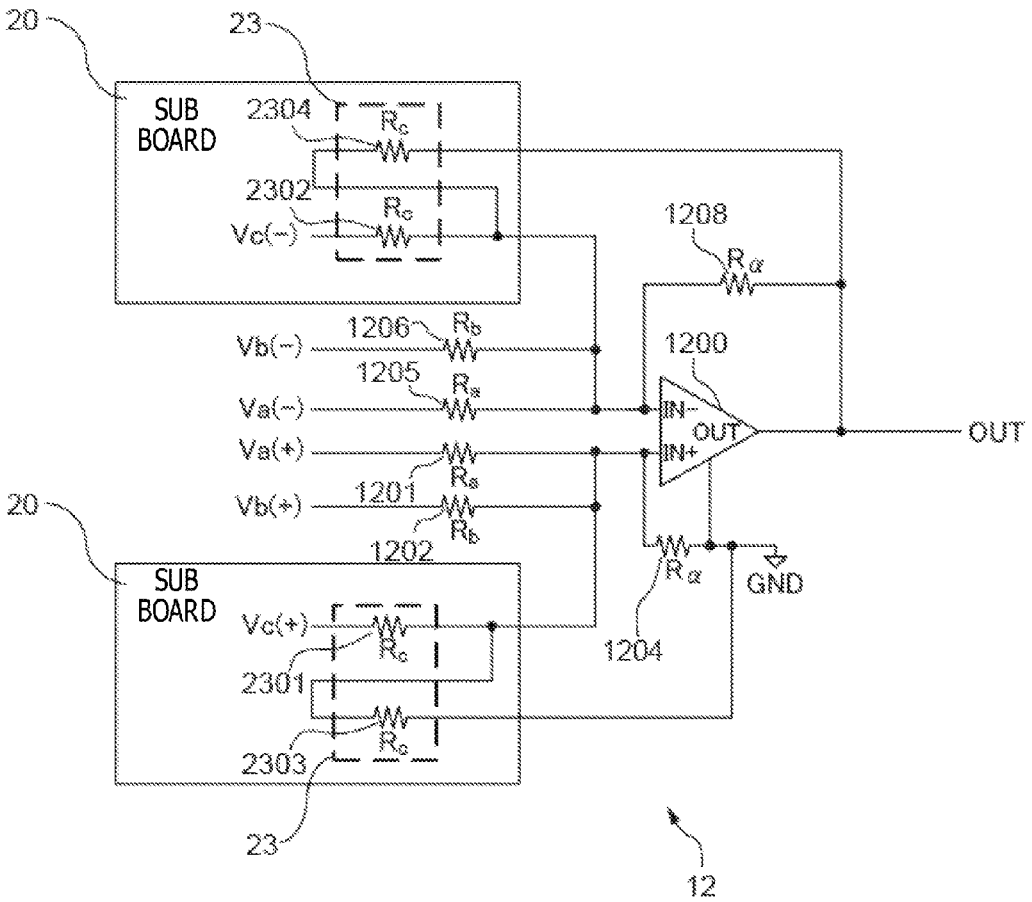
FIG. 8 illustrates an example of a connection relationship between an arithmetic circuit and a voltage range generation circuit.

FIG. 8 illustrates an example of a connection relationship between an arithmetic circuit and a voltage range generation circuit.

The arithmetic circuit 12 includes an operational amplifier 1200, a first load positive resistor 1201, a second load positive resistor 1202, a feedback positive resistor 1204, a first load negative resistor 1205, a second load negative resistor 1207, and a feedback negative resistor 1208. The voltage range generation circuit 23 includes a third load positive resistor 2301, a third load negative resistor 2302, a third feedback positive resistor 2303, and a third feedback negative resistor 2304. Va(+) to Vc(+) and Va(−) to Vc(−) may be power supply voltage information relating to the voltages at the supply terminals of the first load 14 to the third load 21 to which electric powers are supplied, and may be remotely-sensed power supply voltages of the first load 14 to the third load 21 and ground voltage, respectively. The resistances of the first load positive resistor 1201 and the first load negative resistor 1205 may be Ra, the resistances of the second load positive resistor 1202 and the second load negative resistor 1206 may be Rb. The resistances of the third load positive resistor 2301, the third load negative resistor 2302, the third feedback positive resistor 2303, and the third feedback negative resistor 2304 may be Rc. Ra, Rb, and Rc may be values proportional to the power supply voltage ranges of the first load 14, the second load 15, and the third load 21, and may be, for example, Ra:Rb:Rc=10:10:8. The resistances of the feedback positive resistor 1204 and the feedback negative resistor 1208 are Rα, and Rα represents a relationship between the resistances Ra and Rb. For example, the relationship may be Rα=1/(1/Ra+1/Rb).

In the power supply system 1 illustrated in FIG. 7, the arithmetic circuit 12 obtains, as the voltage range signal, the power supply voltage range of the third load 21 included in the sub board 20 from the third load positive resistor 2301 and the third load negative resistor 2302 of the voltage range generation circuit 23, and performs the arithmetic operation. In the power supply system 1, the circuit configuration of the arithmetic circuit 12 may not be changed even in the case where sub boards are exchanged and the power supply voltage range of a load mounted on a sub board is changed since the arithmetic circuit 12 obtains the power supply voltage range of a load mounted on a sub board from the sub board and performs the arithmetic operation.

The third feedback positive resistor 2303 is coupled in parallel to the feedback positive resistor 1204. The third feedback positive resistor 2303 and the feedback positive resistor 1204 form a composite resistance Rcom (Rcom=1/(1/Ra+1/Rb+1/Rc)). The third feedback negative resistor 2304 is coupled in parallel to the feedback negative resistor 1208. The third feedback negative resistor 2304 and the feedback positive resistor 1208 form a composite resistance Rcom (Rcom=1/(1/Ra+1/Rb+1/Rc)).

Figure 9A:
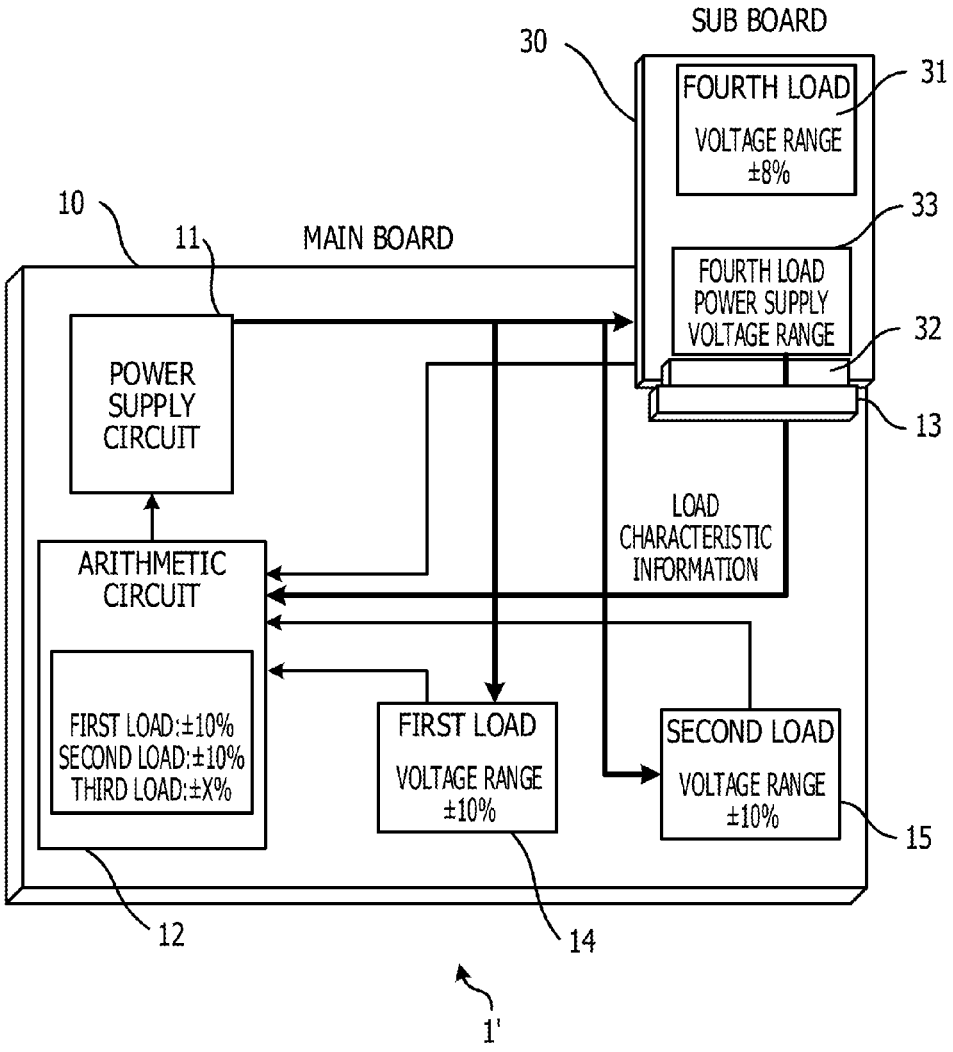
FIG. 9A illustrates an example of a power supply system.
Figure 9B:
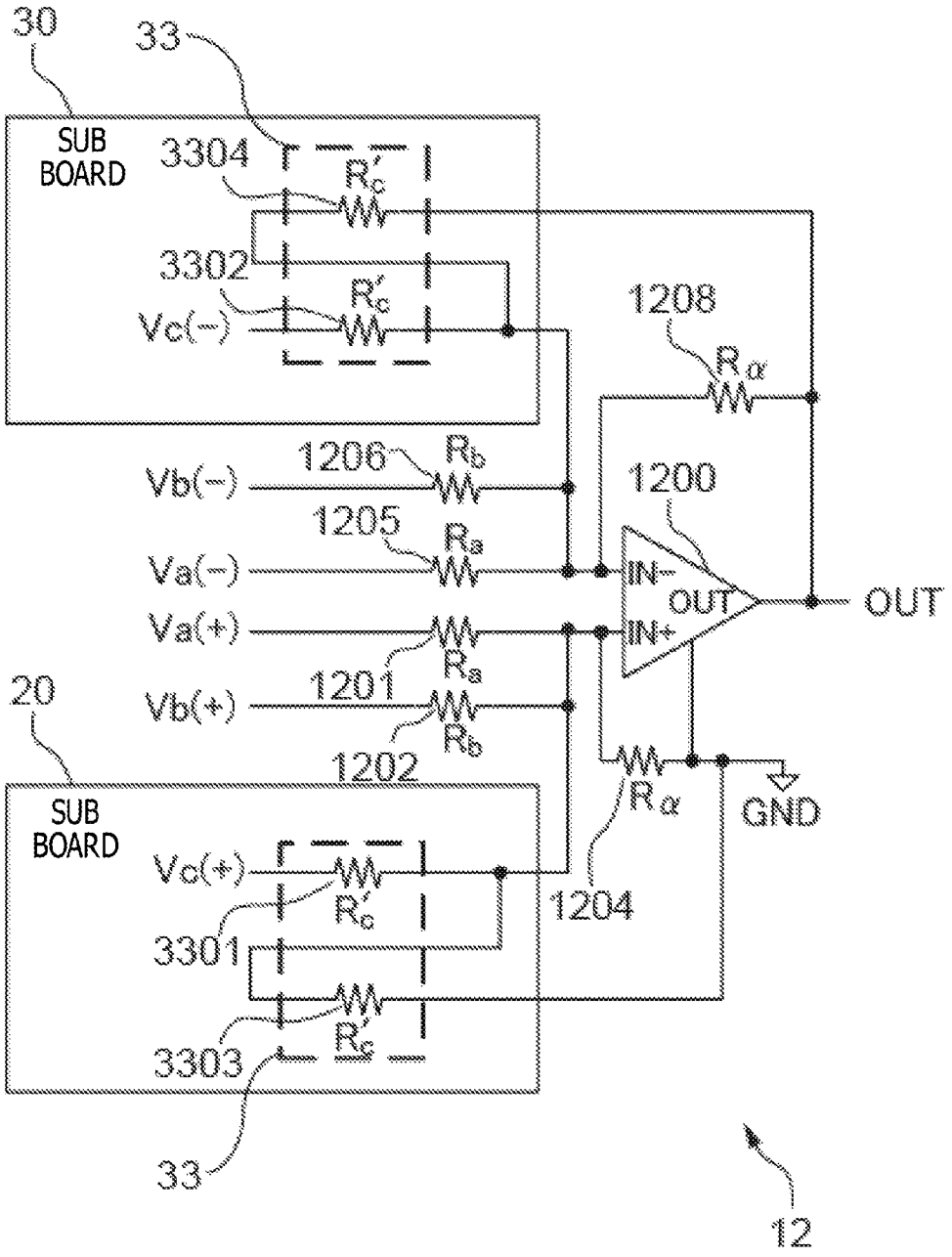
FIG. 9B illustrates an example of a connection relationship between an arithmetic circuit and a voltage range generation circuit.

FIG. 9A illustrates an example of a power supply system. FIG. 9B illustrates an example of a connection relationship between an arithmetic circuit and a voltage range generation circuit. FIG. 9A illustrates the power supply system in a state where sub boards are exchanged, and FIG. 9B illustrates the connection relationship between the arithmetic circuit and the voltage range generation circuit of the power supply system illustrated in FIG. 9A.

In a power supply system 1', a sub board 30 is disposed in place of the sub board 20. The sub board 30 includes a fourth load 31, a sub board input-and-output portion 32, and a voltage range generation circuit 33. The fourth load 31 and the sub board input-and-output portion 32 may have configurations and functions corresponding to those of the fourth load 131 and the sub board input-and-output portion 132 illustrated in FIG. 5 or FIG. 6, respectively. The power supply voltage range of the fourth load 31 may be ±5% that is narrower than the power supply voltage range of the third load 21, which is ±8%.

The voltage range generation circuit 33 includes a fourth load positive resistor 3301, a fourth load negative resistor 3302, a fourth feedback positive resistor 3303, and a fourth feedback negative resistor 3304. The resistances of the fourth load positive resistor 3301, the fourth load negative resistor 3302, the fourth feedback positive resistor 3303, and the fourth feedback negative resistor 3304 is Rc'. Ra, Rb, and Rc' are values proportional to the power supply voltage ranges of the first load 14, the second load 15, and the fourth load 31, and may be, for example, Ra:Rb:Rc'=10:10:5.

The circuit configuration of the arithmetic circuit 12 may not be altered even in the case where the power supply voltage range of a load mounted on the sub board changes since the arithmetic circuit 12 of the power supply system computes the output voltage of the power supply circuit 11 using the voltage range signal output from the voltage range generation circuit included in the sub board.

Figure 10:
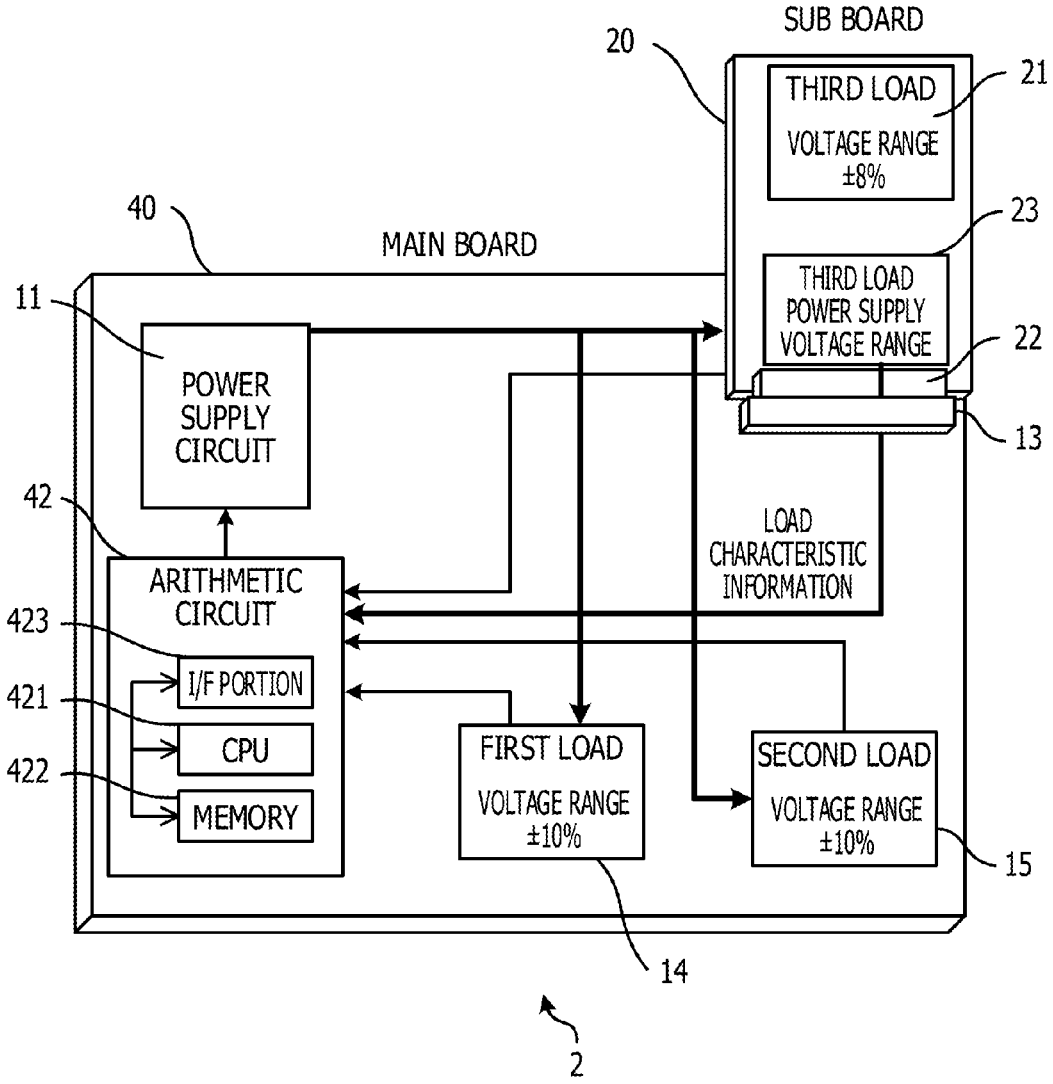
FIG. 10 illustrates an example of a power supply system.

FIG. 10 illustrates an example of a power supply system.

A power supply system 2 illustrated in FIG. 10 is different from the power supply system 1 illustrated in FIG. 7 in that a main board 40 is disposed in place of the main board 10. The main board 40 includes an arithmetic circuit 42 in place of the arithmetic circuit 12. The arithmetic circuit 42 includes a CPU 421, a memory 422, and an interface portion 423. The power supply circuit 11, the arithmetic circuit 42, and the main board input-and-output portion 13 may correspond to a power supply device that supplies electric power to the first load 14, the second load 15, and the third load 21.

The CPU 421 executes a certain process for computing the output voltage of the power supply circuit 11 based on a program stored in the memory 422. The CPU 421 may be coupled to a computer-readable recording medium that stores programs to be executed by the CPU 421. As the recording medium, a portable recording medium such as a CD-ROM, a DVD disk, a USB memory; a semiconductor memory such as a flash memory; a hard disk drive, and the like may be used.

The memory 422 stores programs to be executed by the CPU 421 and a variety of information to be used when the programs are executed. The interface portion 423 receives a voltage range signal from the voltage range generation circuit 23 and signals indicative of remotely-sensed voltages at the supply terminals of the first load 14, the second load 15, and the third load 21, and outputs a signal indicative of the output voltage of the power supply circuit.

Figure 11:
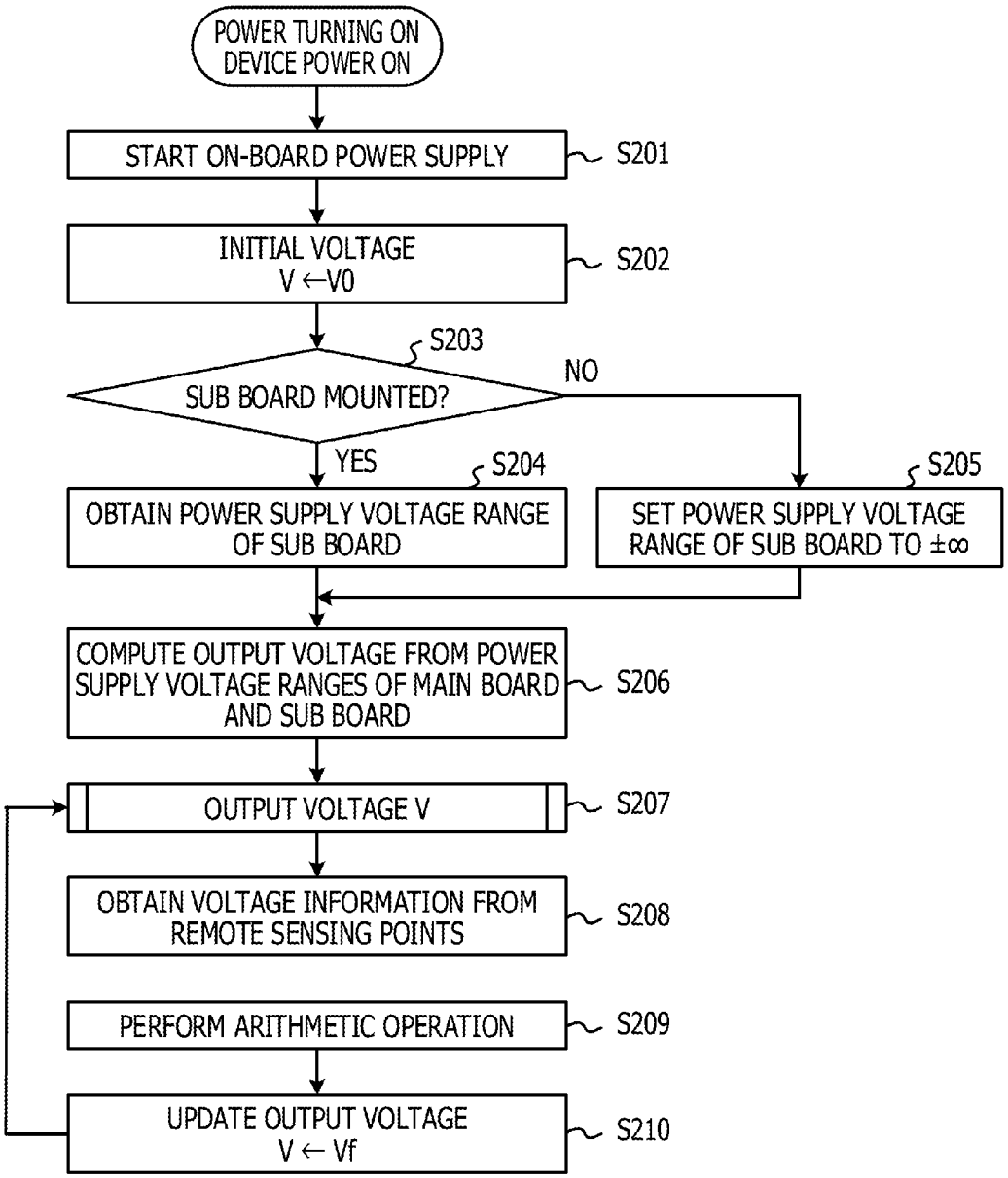
FIG. 11 illustrates an example of a process of a power supply device.

FIG. 11 illustrates an example of a process of a power supply device. A power supply device including the power supply circuit 11, the arithmetic circuit 42, and the main board input-and-output portion 13 illustrated in FIG. 10 may perform the process illustrated in FIG. 11.

When a power supply is turned on, the power supply system 2 starts its operation (S201). The output voltage V of the power supply circuit 11 is set to the reference voltage $V_0$ (S202). The arithmetic circuit 42 determines whether a sub board is mounted on the main board 40 or not (S203). In the case where it is determined that the sub board 20 is not mounted on the main board 40, the arithmetic circuit sets c, which indicates the power supply voltage range of the third load 21, to infinity in the equation (1) (S205). In the case where it is determined that the sub board 20 is mounted on the main board 40, the arithmetic circuit 42 obtains c, which indicates the power supply voltage range of the third load 21, via the main board input-and-output portion 13 (S204). The arithmetic circuit 42 computes the target voltage using the equation (1) and alters the output voltage of the power supply circuit 11 to a voltage corresponding to the target voltage thus computed (S206). The power supply circuit 11 outputs the output voltage V thus set (S207). The arithmetic circuit 42 performs remote sensing of the respective voltages at the supply terminals of the first load 14, the second load 15, and the third load 21, and obtains power supply voltage information indicative of remotely-sensed voltages (S208). The arithmetic circuit 42 computes the target voltage based on the equation (1) using the power supply voltage information thus obtained (S209), and alters the output voltage of the power supply circuit 11 to a voltage corresponding to the target voltage thus computed (S210). The power supply circuit 11 outputs the output voltage V thus altered (S207). Hereinafter, the operations S207 to S210 may be repeated at intervals of a certain time period.

Figure 12:
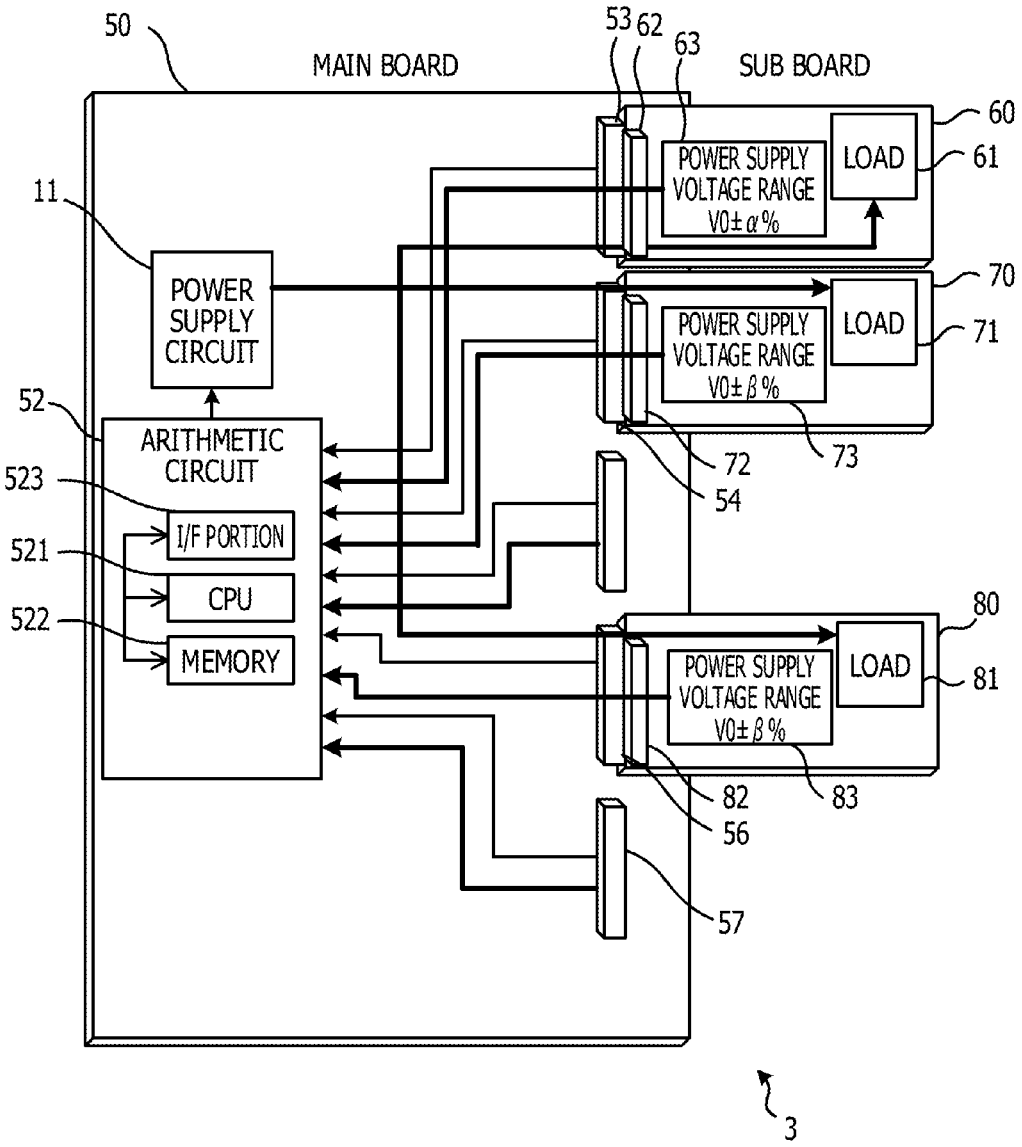
FIG. 12 illustrates an example of a power supply system.

FIG. 12 illustrates an example of a power supply system.

A power supply system 3 includes a main board 50, a first sub board 60, a second sub board 70, and a third sub board 80. The main board 50 includes the power supply circuit 11, an arithmetic circuit 52, and a first main board input-and-output portion 53 to a fifth main board input-and-output portion 57. The first sub board 60 includes a first load 61, a first sub board input-and-output portion 62, and a first voltage range generation circuit 63. The second sub board 70 includes a second load 71, a second sub board input-and-output portion 72, and a second voltage range generation circuit 73. The third sub board 80 includes a third load 81, a third sub board input-and-output portion 82, and a third voltage range generation circuit 83. The power supply circuit 11, the arithmetic circuit 52, and the first main board input-and-output portion 53 to the fifth main board input-and-output portion 57 may correspond to a power supply device that supplies electric power to loads coupled to the first main board input-and-output portion 53 to the fifth main board input-and-output portion 57.

The arithmetic circuit 52 includes a CPU 521, a memory 522, and an interface portion 523. The CPU 521 executes a certain process for computing the output voltage of the power supply circuit 11 based on a program stored in the memory 522. The CPU 521 may be coupled to a computer-readable recording medium that stores programs to be executed by the CPU 521. As the recording medium, a portable recording medium such as a CD-ROM, a DVD disk, a USB memory; a semiconductor memory such as a flash memory; a hard disk drive, and the like may be used. The memory 522 stores programs to be executed by the CPU 521 and a variety of information to be used when the programs are executed. The interface portion 523 receives signals indicative of power supply voltage information relating to remotely-sensed power supply voltages of the loads and voltage range signals from the voltage range generation circuits, and outputs a signal indicative of the output voltage of the power supply circuit.

The arithmetic circuit 52 obtains the power supply voltage ranges of the loads and information relating to the power supply voltages of the loads obtained via the first main board input-and-output portion 53 to the fifth main board input-and-output portion 57. The arithmetic circuit 52 computes the target voltage by using an equation in which weighting is made in accordance with the power supply voltage ranges as is the case with the equation (1), using the information relating to the power supply voltages of the loads and the power supply voltage ranges of the loads, and alters the output voltage of the power supply circuit 11 to a voltage corresponding to the target voltage thus computed.

The first main board input-and-output portion 53 to the fifth main board input-and-output portion 57 may be interface portions to be coupled with sub boards via sub board input-and-output portions of the sub boards.

The first load 61 is a load whose power supply voltage range is the reference voltage $V_0 \pm a$ %, the second load 71 is a load whose power supply voltage range is the reference voltage $V_0 \pm \beta$ %, and the third load 81 is a load whose power supply voltage range is the reference voltage $V_0 \pm \gamma$ %. The first sub board input-and-output portion 62 to the third sub board input-and-output portion 82 may be interface portions with the main board 50.

The first voltage range generation circuit 63 generates a first voltage range signal indicative of the power supply voltage range of the first load 61, and outputs the first voltage range signal thus generated to the arithmetic circuit 52 via the first sub board input-and-output portion 62. The second voltage range generation circuit 73 generates a second voltage range signal indicative of the power supply voltage range of the second load 71, and outputs the second voltage range signal thus generated to the arithmetic circuit 52 via the second sub board input-and-output portion 72. The third voltage range generation circuit 83 generates a third voltage range signal indicative of the power supply voltage range of the third load 81, and outputs the third voltage range signal thus generated to the arithmetic circuit 52 via the third sub board input-and-output portion 82.

Figure 13:
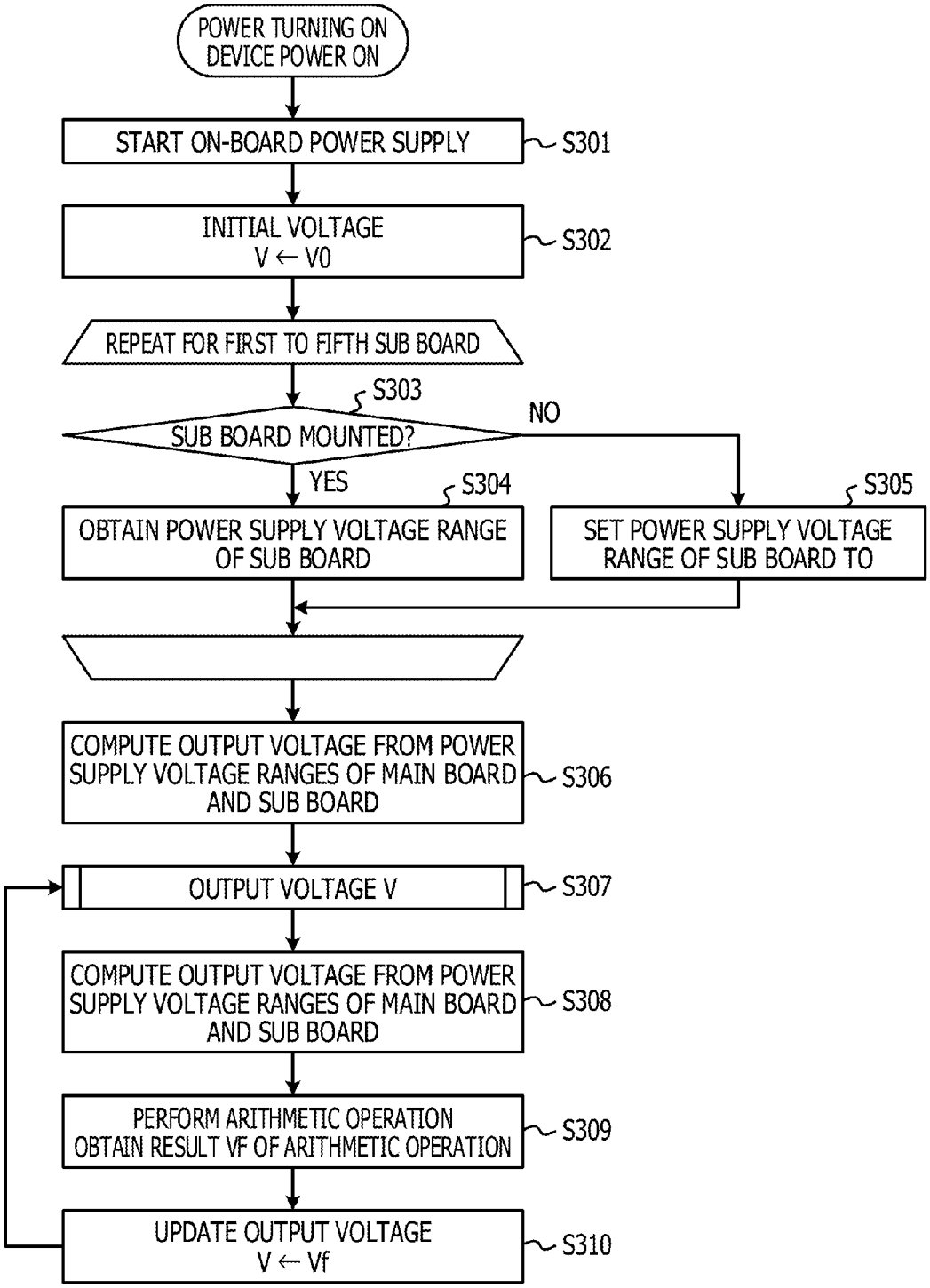
FIG. 13 illustrates an example of a process of a power supply device.

FIG. 13 illustrates an example of a power supply device process. A power supply device including the power supply circuit 11, the arithmetic circuit 52, and the first main board input-and-output portion 53 to the fifth main board input-and-output portion 57 illustrated in FIG. 12 may perform the process illustrated in FIG. 13.

When a power supply is turned on, the power supply system 3 starts its operation (S301). The output voltage V of the power supply circuit 11 is set to the reference voltage $V_0$ (S302). The arithmetic circuit 52 sequentially determines whether a sub board is mounted via the first main board input-and-output portion 53 to the fifth main board input-and-output portion 57 (S303 to S305).

The arithmetic circuit 52 determines that the first sub board 60 is mounted on the main board 50 via the first main board input-and-output portion 53 (S303), and obtains $\alpha$ indicative of the power supply voltage range of the first load 61 via the first main board input-and-output portion 53 (S304). The arithmetic circuit 52 determines that the second sub board 70 is mounted on the main board 50 via the second main board input-and-output portion 54 (S303), and obtains $\beta$ indicative of the power supply voltage range of the second load 71 via the second main board input-and-output portion 54 (S304). The arithmetic circuit 52 determines that no sub board is mounted on the main board 50 via the third main board input-and-output portion 55 (S303), and sets the power supply voltage range of a load to be coupled via the third main board input-and-output portion 55 to infinity (S305). The arithmetic circuit 52 determines that the third sub board 80 is mounted on the main board 50 via the fourth main board input-and-output portion 56 (S303), and obtains $\gamma$ indicative of the power supply voltage range of the third load 81 via the fourth main board input-and-output portion 56 (S304). The arithmetic circuit 52 determines that no sub board is mounted on the main board 50 via the fifth main board input-and-output portion 57 (S303), and sets the power supply voltage range of a load to be coupled via the fifth main board input-and-output portion 57 to infinity (S305).

The arithmetic circuit 52 computes the target voltage using the equation in which weighting according to the power supply voltage ranges is made using the power supply voltage ranges and the information relating to the power supply voltages of the first load 61 to the third load 81 (S306). The arithmetic circuit 52 alters the output voltage of the power supply circuit 11 to a voltage corresponding to the target voltage thus computed. The power supply circuit 11 outputs the output voltage V thus set (S307). The arithmetic circuit 52 performs remote sensing of the respective voltages at the supply terminals of the first load 61 to the third load 81, and obtains power supply voltage information indicative of remotely-sensed voltages (S308). The arithmetic circuit 52 computes the target voltage using the power supply voltage information thus obtained (S309), and alters the output voltage of the power supply circuit 11 to a voltage corresponding to the target voltage thus computed (S310). The power supply circuit 11 outputs the output voltage V thus altered (S307). Hereinafter, the operations S307 to S310 may be repeated at intervals of a certain time period.

In the power supply system, the output voltage of the power supply circuit 11 is computed by weighting in accordance with the power supply voltages of loads and taking a weighted average thereof. Thus, the output voltage of the power supply circuit 11 may be computed even in the case of a narrower power supply voltage range of load.

Figure 14A:
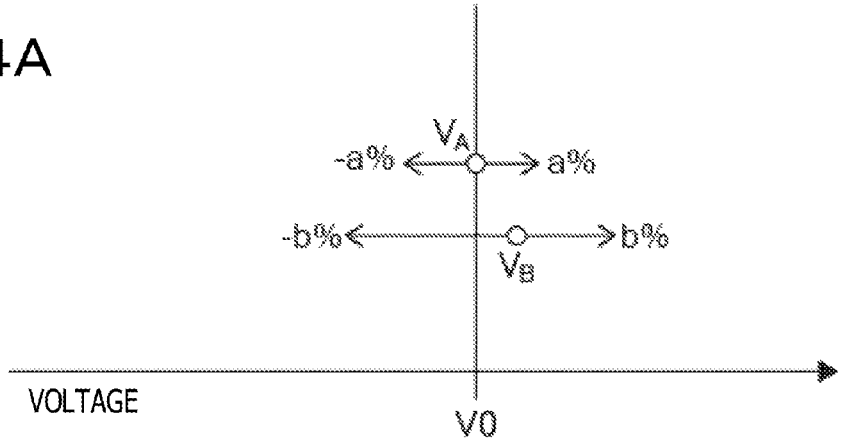
FIG. 14A, FIG. 14B, and FIG. 14C illustrate examples of arithmetic operations.
Figure 14B:
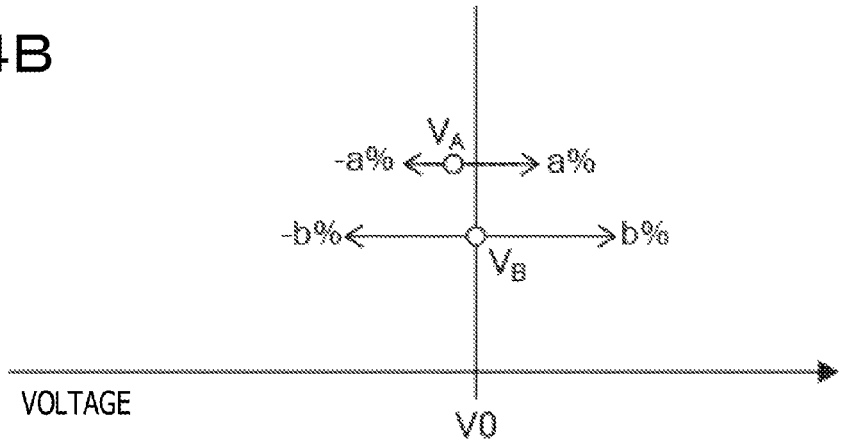
Figure 14C:
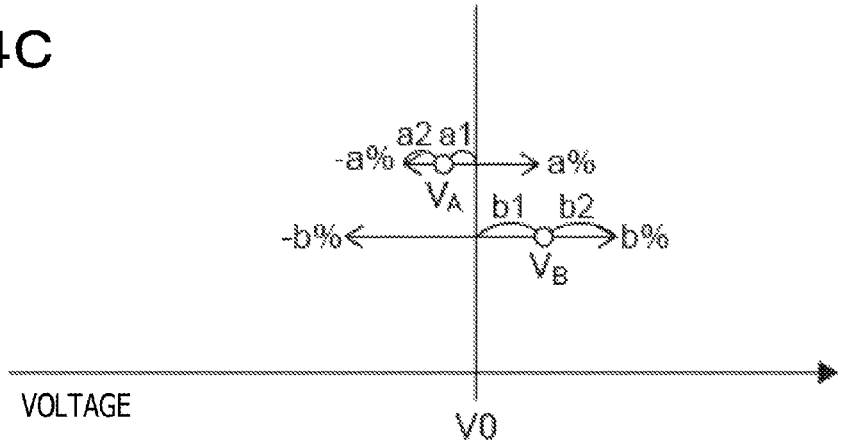

FIG. 14A, FIG. 14B, and FIG. 14C illustrate examples of arithmetic operations. FIG. 14A illustrates an arithmetic operation to be performed to bring the power supply voltage of one load in line with the reference voltage. FIG. 14B illustrates an arithmetic operation to be performed to bring the power supply voltage of the other load in line with the reference voltage. FIG. 14C illustrates an arithmetic operation to be performed with the arithmetic circuit using weighted averaging. In FIG. 14A to FIG. 14C, the horizontal axis represents the voltage, and the vertical axis represents the reference voltage $V_0$ of both loads. $V_A$ represents the power supply voltage of the one load, and $V_B$ represents the power supply voltage of the other load. Arrows extending in parallel with the horizontal axis from the vertical axis represent the power supply voltage ranges of both loads. The power supply voltage range of the load whose power supply voltage is $V_A$ is $V_A$±a %, and the power supply voltage range of the load whose power supply voltage is $V_B$ is $V_B$±b %.

As illustrated in FIG. 14A, in the case where the arithmetic operation is performed to bring the power supply voltage $V_A$ of the one load in line with the reference voltage $V_0$, the power supply voltages of both loads are appropriately computed if a difference ($V_A$−$V_B$) between the power supply voltage $V_A$ of the one load and the power supply voltage $V_B$ of the other load satisfies the following condition:

$$V_0\times(1-b\%)<(V_A-V_B)<V_0\times(1+b\%)$$

As illustrated in FIG. 14B, in the case where the arithmetic operation is performed to bring the power supply voltage $V_B$ of the other load in line with the reference voltage $V_0$, the power supply voltages of both loads are appropriately computed if the difference ($V_A$−$V_B$) between the power supply voltage $V_A$ of the one load and the power supply voltage $V_B$ of the other load satisfies the following condition:

$$V_0\times(1-a\%)<(V_A-V_B)<V_0\times(1-a\%)$$

As illustrated in FIG. 14C, in the case where the arithmetic circuit performs the arithmetic operation using weighted averaging, a voltage V before the arithmetic operation and a voltage V' after the arithmetic operation are in the following relationship:

$$V'=V-ab/(a+b)\times(1/a\times(V_0-V_A)+1/b\times(V_0-V_B))$$

In a stationary state where the voltage V before the arithmetic operation is equal to the voltage V' after the arithmetic operation, the second term in the right side becomes zero:

$$ab/(a+b)\times(1/a\times(V_0-V_A)+1/b\times(V_0-V_B))=0$$

Therefore, the following holds.

$$1/a\times(1-V_A/V_0)=-1/b\times(1-V_B/V_0)$$

Thus, in FIG. 14C, the following relationship holds.

$$a1:a2=b1:b2$$

For example, the power supply voltage $V_A$ of the one load and the power supply voltage $V_B$ of the other load are arranged so as to be on opposite sides of each other across the reference voltage, or the power supply voltage $V_A$ of the one load and the power supply voltage $V_B$ of the other load are arranged in such a way that one of the power supply voltages coincides with the reference voltage. In the case where the arithmetic circuit performs the arithmetic operation using weighted averaging, the power supply voltages of both loads are appropriately computed if the difference ($V_A$−$V_B$) between the power supply voltage $V_A$ of the one load and the power supply voltage $V_B$ of the other load satisfies the following condition:

$$V_0\times(1-(a\%+b\%))<(V_A-V_B)<V_0\times(1+(a\%+b\%))$$

In the power supply system, the power supply voltage range of a load mounted on a sub board is generated in the sub board, and output from the sub board for computation of the output voltage of the power supply circuit. Thus, the power supply voltage may be appropriately determined even in the case where the power supply voltage range of a load mounted on a sub board is changed.

Figure 15A:
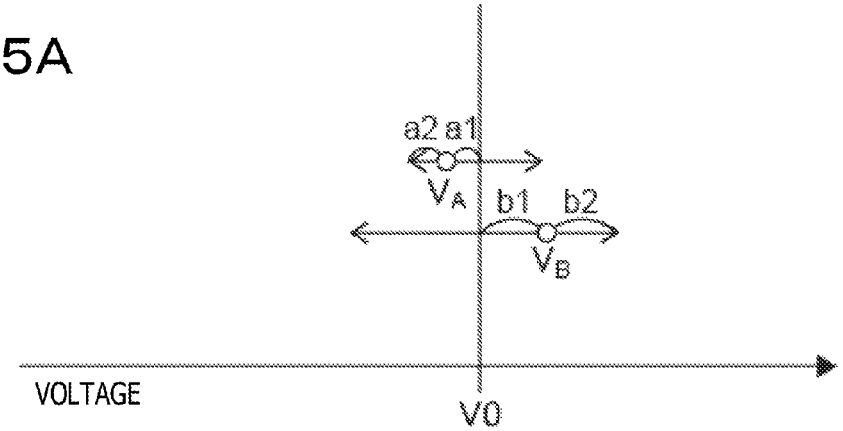
FIG. 15A, FIG. 15B, and FIG. 15C illustrate examples of power supply voltage ranges.
Figure 15B:
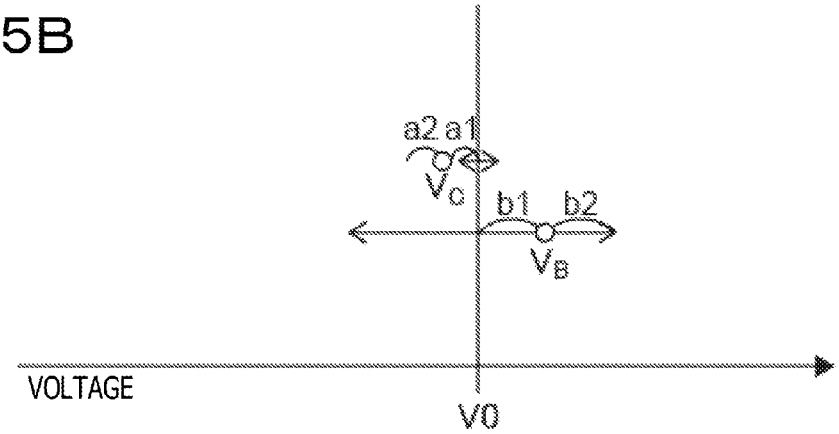
Figure 15C:
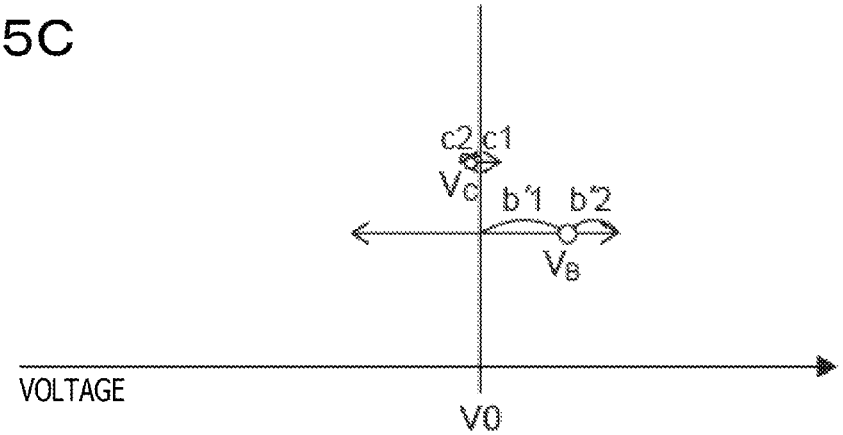

FIG. 15A, FIG. 15B, and FIG. 15C illustrate examples of the power supply voltage ranges. FIG. 15A illustrates a case where the arithmetic circuit performs an arithmetic operation using weighted averaging. FIG. 15B illustrates a case where one load is exchanged and the power supply voltage range is changed. FIG. 15C illustrates a case where one load is exchanged and the power supply voltage range is changed. In FIG. 15A to FIG. 15C, the horizontal axis represents the voltage, and the vertical axis represents the reference voltage $V_0$ of both loads. $V_A$ represents the power supply voltage of the one load, $V_B$ represents the power supply voltage of the other load, and $V_C$ represents the power supply voltage of a load exchanged. Arrows extending in parallel with the horizontal axis from the vertical axis represent the power supply voltage ranges of both loads. The power supply voltage range of the load whose power supply voltage is $V_A$ is $V_A$±a %, the power supply voltage range of the load whose power supply voltage is $V_B$ is $V_B$±b %, and the power supply voltage range of the load whose power supply voltage is $V_C$ is $V_C$±c %.

In FIG. 15A, as is the case with FIG. 14C, the power supply voltages of both loads are appropriately computed in the following condition:

$$V_0\times(1-(a\%+b\%))<(V_A-V_B)<V_0\times(1+(a\%+b\%))$$

In the case where the one load is exchanged in the state of FIG. 15A and the power supply voltage range is changed from ±a to ±c, in FIG. 15B, the power supply voltages of both loads are appropriately computed if a difference ($V_C$−$V_B$) between the power supply voltage $V_C$ of the load and the power supply voltage $V_B$ of the other load satisfies the following condition:

$$c/a\times V_0\times(1-(c\%+b\%))<(V_C-V_B)<c/a\times V_0\times(1+(c\%+b\%))$$

As illustrated in FIG. 15C, in the case where the arithmetic circuit performs the arithmetic operation using weighted averaging, the power supply voltages of both loads are appropriately computed if the difference ($V_C$−$V_B$) between the power supply voltage $V_C$ of the load and the power supply voltage $V_B$ of the other load satisfies the following condition:

$$V_0\times(1-(c\%+b\%))<(V_C-V_B)<\times V_0\times(1+(c\%+b\%))$$

In the power supply system, the arithmetic operation may be performed in a wider range.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A power supply device comprising:

a power supply circuit configured to supply electric power;

a signal input-and-output portion to be coupled to a sub board, the sub board including a first load configured to receive the electric power and a voltage range generation circuit configured to generate a voltage range signal indicative of a power supply voltage range of the first load; and an arithmetic circuit configured to compute an output voltage of the power supply circuit based on the voltage range signal which is input via the signal input-and-output portion and first power supply voltage information relating to a first voltage at a first supply terminal of the first load to be supplied with the electric power, the sub board includes: a third load configured to receive the electric power, and wherein the arithmetic circuit computes the output voltage of the power supply circuit by weighting the first power supply voltage information and third power supply voltage information in accordance with respective power supply voltage ranges of the first load and the third load, the third power supply voltage information relating to a third voltage at a third supply terminal of the third load to be supplied with the electric power.

2. The power supply device according to claim 1, wherein the sub board further includes: a sub board input-and-output portion configured to output the voltage range signal and receive the electric power from the power supply circuit.

3. The power supply device according to claim 1, wherein the arithmetic circuit obtains the first power supply voltage information by remote sensing.

4. The power supply device according to claim 1, further comprising:

a second load configured to receive the electric power, wherein the arithmetic circuit computes the output voltage of the power supply circuit by weighting the first power supply voltage information and second power supply voltage information in accordance with respective power supply voltage ranges of the first load and the second load, the second power supply voltage information relating to a second voltage at a second supply terminal of the second load to be supplied with the electric power.

5. The power supply device according to claim 1, wherein the voltage range generation circuit includes a resistor element having resistance corresponding to the power supply voltage range of the first load.

6. The power supply device according to claim 1, further comprising:

a first resistor element having first resistance corresponding to the power supply voltage range of the first load;

a second load configured to receive the electric power; and a second resistor element having second resistance corresponding to the power supply voltage range of the second load, wherein the arithmetic circuit includes an operational amplifier coupled to the first resistor element and the second resistor element.

7. A power supply system comprising: a main board; and a sub board, coupled to a signal input-and-output portion of the main board, including a first load, the main board includes:

a power supply circuit configured to supply electric power to the first load; and an arithmetic circuit configured to compute an output voltage of the power supply circuit based on a voltage range signal and first power supply voltage information, the voltage range signal indicating a power supply voltage range of the first load and being input via the signal input-and-output portion, the first power supply voltage information relating to a first voltage at a first supply terminal of the first load to be supplied with the electric power, the sub board includes: a third load configured to receive the electric power, and wherein the arithmetic circuit computes the output voltage of the power supply circuit by weighting the first power supply voltage information and third power supply voltage information in accordance with respective power supply voltage ranges of the first load and the third load, the third power supply voltage information relating to a third voltage at a third supply terminal of the third load to be supplied with the electric power.

8. The power supply system according to claim 7, wherein the sub board further includes: a sub board input-and-output portion configured to output the voltage range signal and receive the electric power from the power supply circuit.

9. The power supply system according to claim 7, wherein the arithmetic circuit obtains the first power supply voltage information by remote sensing.

10. The power supply system according to claim 7, further comprising:

a second load configured to receive the electric power, wherein the arithmetic circuit computes the output voltage of the power supply circuit by weighting the first power supply voltage information and second power supply voltage information in accordance with respective power supply voltage ranges of the first load and the second load, the second power supply voltage information relating to a second voltage at a second supply terminal of the second load to be supplied with the electric power.

11. The power supply system according to claim 7, wherein the voltage range generation circuit includes a resistor element having resistance corresponding to the power supply voltage range of the first load.

12. The power supply system according to claim 7, further comprising:

a first resistor element having first resistance corresponding to the power supply voltage range of the first load;

a second load configured to receive the electric power; and a second resistor element having second resistance corresponding to the power supply voltage range of the second load, wherein the arithmetic circuit includes an operational amplifier coupled to the first resistor element and the second resistor element.

13. A power supply control method comprising:

determining whether a sub board on which a first load, a voltage range generation circuit and a third load are mounted is coupled or not, the first load configured to receive electric power from a power supply circuit, the voltage range generation circuit configured to generate a voltage range signal indicating a power supply voltage range of the first load, the third load configured to receive the electric power;

obtaining, when the sub board is coupled, the voltage range signal and first power supply voltage information relating to a first voltage at a first supply terminal of the first load;

computing an output voltage of the power supply circuit using the voltage range signal and the first power supply voltage information; and computing the output voltage of the power supply circuit by weighting the first power supply voltage information and third power supply voltage information in accordance with respective power supply voltage ranges of the first load and the third load, the third power supply voltage information relating to a third voltage at a third supply terminal of the third load to be supplied with the electric power.

14. The power supply control method according to claim 13, wherein the first power supply voltage information are obtained by remote sensing.

15. The power supply control method according to claim 13, wherein the computing is performed by weighting the first power supply voltage information and second power supply voltage information in accordance with respective power supply voltage ranges of the first load and a second load, the second power supply voltage information relating to a second voltage at a second supply terminal of the second load to be supplied with the electric power.

* * * * *